US005687773A

United States Patent [19]

Ryan et al.

[11] Patent Number: 5,687,773

[45] Date of Patent: Nov. 18, 1997

[54] EXHAUST PIPE COVER AND METHOD OF COVERING AN EXHAUST PIPE

[76] Inventors: Stephen M. Ryan; Elizabeth C. Ryan, both of 5144 Parkside Dr., Grizzly Flat, Calif. 95636

[21] Appl. No.: 660,164

[22] Filed: Jun. 3, 1996

[51] Int. Cl.[6] ..... F16L 57/00

[52] U.S. Cl. ..... 138/96 R; 138/89.4; 138/109; 138/110; 454/4

[58] Field of Search ..... 138/89.1, 89.4, 138/96 R, 109, 110; 42/96; 16/115; 181/211, 243; 454/4; 60/324

[56] References Cited

U.S. PATENT DOCUMENTS

| | | | |
|---|---|---|---|
| 517,919 | 4/1894 | Frerichs | 454/4 |
| 2,942,625 | 6/1960 | Costanzo | 138/96 R |
| 4,106,290 | 8/1978 | Johnson | 454/4 |
| 4,158,407 | 6/1979 | Rest | 138/96 R |
| 4,168,726 | 9/1979 | Klennert | 138/96 R |
| 4,255,928 | 3/1981 | Jones et al. . | |
| 4,375,115 | 3/1983 | Zimmermann | 15/104.04 |
| 4,911,039 | 3/1990 | Lubbock et al. | 16/115 |
| 5,170,020 | 12/1992 | Kruger et al. | 181/211 |
| 5,520,219 | 5/1996 | Hessian | 138/96 R |

*Primary Examiner*—David Scherbel
*Assistant Examiner*—James F. Hook

[57] ABSTRACT

A removable exhaust pipe cover for placement over an exhaust pipe opening of a non-running internal combustion engine for excluding water and debris from entering the pipe. The cover is an elongated tubular member of water repellant material which is preferably flexible to a degree, the flexibility being for allowing constricting and sealing against the pipe when in use, and for compact folded or collapsed storage of the cover when not in use. The tubular cover has a closed top end, an oppositely disposed open bottom end, and an annular sidewall extending between the two ends. The bottom open end of the cover, in at least one embodiment, has a elasticized gathered hem which holds the cover tightly closed about the exhaust pipe with the closed top end and upper portion of the sidewall covering and thus closing the open end of the pipe when installed. An elongated telescopic pole is provided for engaging and positioning the cover over an exhaust pipe terminal end, particularly an end which is high above the ground. The pole and cover include cooperative structuring for allowing use of the pole to remove the cover from the exhaust pipe end when the internal combustion engine is to be operated.

8 Claims, 5 Drawing Sheets

EXHAUST PIPE COVER AND METHOD OF COVERING AN EXHAUST PIPE

BACKGROUND OF THE INVENTION

1. Field of the Invention

This invention relates to protective coverings for temporarily closing the open ends of exhaust pipes of internal combustion engines, particularly vertical pipes, for the purpose of preventing entry of rain, leaves, and other foreign matter into the non-operating engine exhaust system. Methods of use of the protective coverings are also disclosed.

2. Description of the Prior Art

Contamination from falling or blowing rain, leaves and other airborne foreign matter is a problem with tractor-trucks (henceforth "trucks") for moving cargo on highways, farm tractors and related machinery, diesel and gas powered generators and pumps, boats and like engine-powered machinery having internal combustion engines and associated exhaust pipes, and particularly exhaust pipes having terminal end sections or lengths in a vertically oriented position adjacent the terminal end opening. The problem also exists to a degree with horizontally disposed exhaust pipe terminal end sections or lengths adjacent the exhaust opening. Henceforth the aforementioned internal combustion engine powered machines may be jointly referred to as "machinery" for expediency.

Rain water, leaves and like foreign matter entering the exhaust pipe of a non-running internal combustion engine can corrode and deteriorate the exhaust system, eventually leading to polluting gasses, noise pollution and contaminated liquid leaks, and the need for costly repairs. Additionally, water alone collected in the pipe, or water in combination with a build up of extraneous material such as leaves, can block the exhaust pipe and cause difficulty in starting the engine, due to back pressure and the inability of the engine to properly exhaust gasses. The initial pressure from starting the engine will usually not eject all of the foreign matter, but only some of the material, and the resultant continued back pressure will cause poor engine performance which will lead to excess pollution due to improperly burned fuel, higher fuel operating costs and loss of engine power. When starting the engine, the ejected material from the exhaust pipe, which is blown-out the exhaust opening by exhaust pressures of the engine, is generally very dirty since it is combined with soot lining the exhaust pipe, and this is particularly true when water has entered the pipe, and a good portion of this ejected material will often be deposited on the truck or machinery, and the balance on the areas surrounding the machinery, to possibly be washed into streams and lakes. The soot and debris is aesthetically unappealing to truck and machinery owners, and it can be corrosive or otherwise damaging to paint and like finishes.

This exhaust pipe contamination problem is most prevalent with exhaust pipes which extend upward vertically at or near the terminal end thereof, and which are exposed to the weather, and have an open terminal end which may be aiming either vertically straight-up or horizontally. Typically, rain and other contaminates do not enter such exhaust pipes when the engine is operating, due to the excluding nature of exiting exhaust gasses. Rain entering an exhaust pipe of an operating engine will usually be evaporated by the heat of the exhaust system, and thus is relatively quickly eliminated with the exhaust gasses. The contaminates which are of significant concern enter the exhaust pipe open-end when the engine is not operating, such as when a truck is parked overnight for example.

In an attempt to avoid the problem of entrance of foreign material into such exhaust systems, some vertical exhaust pipes have been manufactured with a short curved upper end having a horizontal rather than a vertically aiming opening, which on a truck faces toward the back or side of the vehicle. However, with this type of exhaust pipe terminal end having a horizontal aiming opening on an otherwise vertical exhaust pipe section, when the engine is not operating, wind can carry rain and debris somewhat laterally directly into the opening of the exhaust pipe, wherein the contaminates drop downward in the exhaust piping to collect in low and horizontal portions of the exhaust system.

There exist prior art devices attempting to eliminate entrance of rain and debris into the exhaust pipes of non-running engines. These prior art devices include hinged or pivotally attached cap assemblies which are permanently mounted to the end of the exhaust pipes, and which are biased into a normally closed position when the engine is shut-down. The caps are light in weight and properly balanced so as to be opened by the exhaust pressure of an operating engine, and return to the closed position, closing the exhaust opening when the engine is off, the return biasing being caused by weight distribution of the cap relative to the pivot. Disadvantages of hinged cap type exhaust covers include the fact that the engine power must be utilized to force and hold open the caps due to a small but continuous exhaust flow restriction created by the very nature of such caps trying to close the opening, and although this is a small amount of engine power being utilized to hold the cap open, over many thousands of hours of operation of the engine, this will equate to a significant amount of fuel being burned just to hold the cap in the open position. If the cap is extremely easily opened, then it can become easily stuck open with just a small amount of frictional adhesive in the pivot components. These caps can also provide increased wind resistance, which on a moving vehicle can cause increased fuel consumption. Another problem associated with hinged cap covers is jamming of the mechanical hinge, most commonly resulting in the cap remaining in the open position after the engine is shut-down. Another disadvantage is the annoying noise resulting as the cap opens and closes, banging against the top or end of the exhaust pipe, which can become an almost constant clatter when the engine is idling, due to inconsistent exhaust pressures as the pistons and exhaust valves of the engine move more slowly. Another problem associated with hinged cap covers is the permanent alteration of the exhaust pipe appearance, which to many appearance-sensitive truckers is generally unappealing.

One such pivotal cap assembly is shown in U.S. Pat. No. 4,255,928, issued to W. Richard Jones et al in March of 1981, and exemplifies such devices. The Jones device shows a Swingable Rain Cover For Vertical Exhaust Pipes With Stop Means which includes a cap pivotally affixed to a clamp member which is affixable to an exhaust pipe. The clamp member is secured about the end of the exhaust pipe with the cap resting against the rim of the pipe while the engine is not running. The cap is light in weight so as to remain open while exhaust is being emitted from the pipe. The Jones device also attempts to address the noise problem associated with similar prior art devices, and has a muffling structure between the contact of the cap with the exhaust pipe.

It has been observed that many truckers being dissatisfied with existing hinged-cap exhaust covers have themselves attempted to resolve the previously mentioned problems associated with water and debris entering the exhaust pipes by applying a cover, generally consisting of a tin can or bucket, over the end of the exhaust pipe particularly prior to stormy weather. However, the truckers must climb up onto the exterior of their trucks to reach the end of the exhaust pipe, which is often about fourteen feet from the ground. This is particularly dangerous in stormy weather since there are no steps or adequate hand holds on the truck designed for this purpose. This procedure also requires the climbing back up on the truck to physically remove the cover before starting the engine. While use of a ladder might be safer, it is also much more time consuming, and truckers do not carry ladders with them as space is limited on a truck. Additionally, absent a securing arrangement other than the light weight of the tin can or bucket, significant wind can raise and dislodge these home-made attempted solutions to the problem.

Therefore, there is a need for a reuseable exhaust pipe cover which can be quickly, easily and safely affixed over the exhaust pipe opening of an internal combustion engine to prevent entrance of foreign matter when the engine is off, and easily and quickly removed for operation of the engine.

SUMMARY OF THE INVENTION

The following detailed description is of best modes for carrying out the invention given for exemplification to allow those skilled in the art to build and use the invention, and clearly some changes can be made to that which is specifically herein described and shown in the included drawings, but in the interest of brevity of this disclosure, all of these changes which fall within the scope of the invention have not herein been detailed, but will become apparent to those skilled in the art.

The present invention includes removable and reuseable exhaust pipe covers and methods of use, and methods and pole structures pertaining to safely and easily covering an exhaust pipe opening which is elevationally high, or otherwise difficult to reach.

The present exhaust pipe covers of which several embodiments are herein detailed for example, are structured to allow the installation and removal thereof utilizing an elongated pole, although the cover could be applied by hand such as to a horizontal or vertical pipe end which is not difficult to reach. A first end of the lightweight pole is manually graspable and manipulable, such as when the user is standing on the ground, and includes a first component engagement structure at the pole second end for holding the cover by a cooperative second component engagement structure affixed to the cover for both installation and removal of the cover relative to the exhaust pipe terminal end. The elongated pole is particularly useful for manipulating the cover relative to exhaust pipes which have the terminal open ends thereof substantially elevated above ground level, such as on a truck wherein oftentimes the terminal end opening of the exhaust pipe is approximately 14 feet above grade, or alternatively, when the exhaust pipe terminal end exits through a structure roof and is difficult to reach due to elevational and/or physical restraints of the structure, which is fairly common with commercial fishing boats and back-up power generators housed in small protective sheds. The elongated pole is preferably collapsible, preferably being telescopic in nature to allow compact storage thereof when not in use, and length adjustability during use.

A suitable cover in accordance with the invention is a tubular member having a closed top end and an open bottom end for fitting over an exhaust pipe end and sealing the pipe opening against the entrance of rain, leaves and the like when the engine is not operating. The cover includes a securing arrangement for preventing wind from dislodging it from the exhaust pipe. The cover includes structuring cooperative with compatible structuring on the elongated pole second end to allow the pole to be used to apply and remove the cover.

The covers are preferably a soft or non-marring sack or bag-like structure which will not scratch the exhaust pipe, with the body of the covers made of water repellant or water proof material so as to not pass rain water and other foreign matter therethrough, with this attribute of the material henceforth being designated as water repellant. The material defining the cover body is preferably flexible to a degree or in given areas to allow intentional collapsing for compact storage, and for tightening around an exhaust pipe as will become appreciated with continued reading. The material of the cover body may include a degree of stiffness so the body maintains a generally up-right condition with open interior to allow the cover body to be somewhat "dropped" onto or over the end of an exhaust pipe, or alternatively, the cover body may be highly flexible so as to be attachable by pulling on, somewhat like pulling on a sock.

When the cover is in use over a vertically oriented exhaust pipe, the closed end of the cover is upward and aided by the cover sidewall in closing the pipe opening, and the open end of the cover is about the exhaust pipe below the pipe end opening and the below the closed end of the cover. The internal diameter of the tubular cover is larger than the exterior size of the exhaust pipe to allow for easy placement of the open end of the cover over the open end of the pipe. The present covers can be made in a range of sizes for widely differing pipe diameters, and one size of cover can be used on somewhat differing sizes of exhaust pipes in a given size range.

A first embodiment of the cover described for example includes an angled shaped closed upper end, which is particularly well adapted for use with exhaust pipes having sloped terminal ends. Although ideally suited for exhaust pipes having sloped or angled ends, and inexpensive to manufacture, this embodiment will also work with exhaust pipes having flat or perpendicular ends, or short horizontal bends just prior to the end openings, all of which are common exhaust pipe terminal end shapes. A semi-rigid section of foam rubber or like reinforcing material is preferably affixed against the inside surface of the closed end of this cover to not only help maintain the expanded shape of the cover, but to reduce wear and tear on the material from the edge of the exhaust pipe, as the covers are intended to be reusable many times, and are preferably made durable and washable. An edge or hem of the open end of this cover is gathered into a normally inwardly collapsed smaller diameter than the cover body above the gather, and substantially smaller than the exhaust pipe external diameter, and retains a small diameter elastic band to draw the gather inward. With this embodiment, a terminal end of the telescopic pole includes an annular rigid band sized slightly smaller in exterior diameter than the stretched or expanded opening of the cover, and larger than the exhaust pipe terminal end. The band is preferably foldable and adjustable in extending-angle relative to the pole for more compact storage and convenient use, and is made of, or covered with material such as plastics not likely to scratch the exhaust pipe. The band extends laterally off of the pole for use, and is substantially larger in the open center than the exhaust pipe exterior diameter. The gathered lower end of the cover is stretched manually by hand and placed over the exterior of the band which maintains the open end at the expanded diameter, and in a generally horizontal position in relation to the upright or vertical pole, for easier placement over the end of the exhaust pipe. The pole is used to raise the open end of the cover above the exhaust pipe terminal end, and then to lower the band and cover over the pipe end to locate the cover over the pipe, wherein the closed end of the cover and the cover in general closes the exhaust opening. When the end of the exhaust pipe abuts the inside top surface of the cover, the cover is restrained from further downward movement, and the band can then be easily detached from engagement with the gathered hem of the cover by pulling the pole and thus band further downward. The elastic gather of the cover slips from the band in this step. The gathered hem then snaps tightly about the exhaust pipe, and strongly frictionally adheres to the pipe exterior. The pole is then raised to pass the band upward over the exterior surface of cover, which is now somewhat collapsed, and the band is removed from the top of the exhaust pipe and cover. The telescopic pole can now be retracted into a much shorter length, and the band can be pivoted downward to rest adjacent the pole for easier, more compact storage. The tightened elastic gather is sufficient to keep the cover in place during high wind conditions, and the water repellent nature of the cover body prevents rain and like foreign matter from entering the exhaust pipe through the now covered terminal end opening. To remove the cover, the telescopic pole is extended, and a hook attached on the upper end of the telescopic pole adjacent the band is used to catch a ring or like exposed upwardly engagable structure connected to the cover allowing the pole to be used to pull the cover upward and off of the exhaust pipe, as the frictional gripping of the elastic hem, although strong, can be defeated by the manually operated pole.

Another embodiment of the cover described for example includes a flat or horizontally positioned closed top end which is shaped more commensurately with exhaust pipes with flat terminal ends and vertically aiming openings, although it will function with other shapes of exhaust pipe terminal ends. The inside surface of the closed upper end of this embodiment also preferably has a foam rubber member or like re-enforcement for protection of the fabric and for helping maintain the expanded shape of the closed end of the cover. The lower open end of this second embodiment contains a rigid ring contained in a hem which maintains the terminal end opening in a permanently expanded circular condition with an interior opening larger than the exterior diameter of the exhaust pipe. Adjacent the bottom open end of the cover and a little upward therefrom, between the ring and the closed end of the cover, is a retained band (draw-string) within an interior hem, with a looped portion of the band being accessible through an opening in the sidewall of the cover. An exposed ring is attached around the exposed portion of the band which can be grasped by a hook endwardly affixed to a telescopic pole, a telescopic pole which in this case does not include the laterally extending rigid band as previously described for holding an elastic gather open. To apply this cover to the exhaust pipe, a ring affixed to the top surface of the cover is located in the hook on a telescopic pole and the pole used to lift and guide the cover over the exhaust pipe opening, alternatively the pole hook is inserted into an inverted pocket on the cover for lifting the cover with the pole. Another alternative is the use of hook and loop fastener as will be described later. Once the cover is applied and lowered over the exhaust pipe, the hook on the pole is used to hook the ring of the draw-string band and to pull the band adjacent the lower end until the hem containing the band is inwardly collapsed and is engaged frictionally against the sides of the exhaust pipe. The tightened band is sufficient to keep the cover in place during high winds conditions. A second opening with exposed loop of the band with attached ring can also be used with this second embodiment which is positioned on the opposite side of the cover from the first opening, which can be used to loosen the tightened band for easier removal of the cover from the exhaust pipe. However, the draw-string band cinching mechanism can simply be overcome, without the use of the second exposed band loop, by merely pulling the cover from the exhaust pipe with firm pressure using the pole hook engaged in the top ring of the cover, or inverted pocket.

Another structure which can be used for applying and removing the second embodiment of the cover includes the inverted pocket, as previously mentioned, located on the exterior of the cover adjacent the upper end. An opening of the pocket faces downward in the same direction as the opening of the cover. The hook of the telescopic pole can be inserted into the pocket whereby the cover is supported for placement and removal of the cover.

The preferred material of which the cover body is manufactured, is preferably a tightly woven fabric or plastics material such as vinyl-impregnated nylon or water repellant canvas, and is preferably heat resistant to a degree to allow the placement of the cover over an exhaust pipe end immediately after shutting down the engine, although it could conceivably be made of materials generally applicable to exhaust pipe ends which have cooled-down. Many of the fabrics used for manufacturing back-packs and tents are suitable from which to make the present covers economically such as by sewing.

One of the many advantages of the present invention is that the cover is easy to apply and remove, reuseable, and non-damaging or marring to the exhaust pipe. The pole and cover arrangement allows for the safe and convenient covering of an elevationally high or otherwise difficult to reach exhaust pipe end. The attached cover on the exhaust pipe will remain in place even in high winds or while the truck is being towed or transported. The cover and the telescopic pole can be easily and conveniently stored without consuming a large amount of space. The cover and pole are relatively inexpensive to manufacture, and thus could be sold to the consumer at a reasonable price. The cover can be color coordinated to match various machinery or company colors, and can be imprinted or otherwise decorated with various logos or advertising information. The covers when used, exclude water and like foreign matter from entering the mouth of the pipe, and thus will help prevent exhaust pipe corrosion. The cover when removed from the pipe, allows the engine to be operated generally with greater efficiency, i.e., easier starting, better fuel economy, and less pollution output due to no abnormal exhaust restrictions since water and debris have been fully excluded by the cover. The cover is not permanently affixed and therefore would not potentially detract from the operating appearance of the vehicle. The covers are preferably made of materials suitable to be washable, at least with a damp cloth, so they can be easily kept clean.

These, as well as other attributes, objects and advantages of the present invention will become more fully appreciated with continued reading and by examining the included drawings.

BEST MODES FOR CARRYING OUT THE INVENTION

Figure 5:
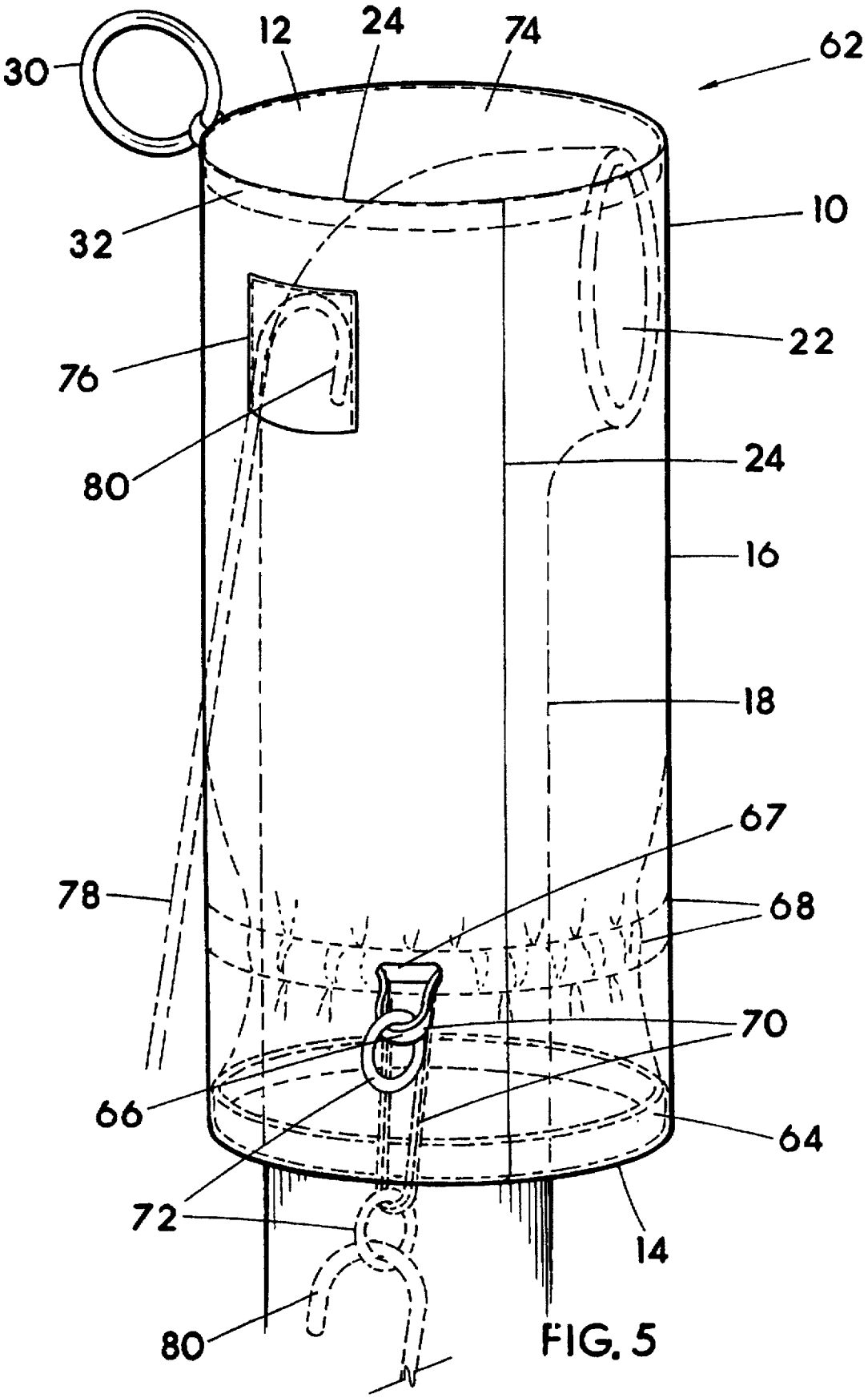
FIG. 5 is a top perspective view of the aforementioned second embodiment of the cover showing a curved horizontally positioned exhaust pipe terminal end located within the cover. For illustrative purposes, hooks on the ends of poles are also shown inside an inverted pocket, and pulling a draw-string ring.

Any dimensions henceforth provided in this section in terms of inches or feet are for example only to aid the reader, as we do not necessarily wish our invention to be restricted to these narrow examples. Referring now to the drawings in general, and to drawing FIGS. 1 and 5 where a first embodiment 26, and a second embodiment 62 of the cover 10 is illustrated for example. Cover embodiments 26 and 62 are each basically a tubular sack or sock having a closed top end 12 and an oppositely disposed openable or open bottom end 14, joined by an annular sidewall 16. Sidewall 16 is approximately eight inches in diameter which allows for sufficient space for easy placement of cover embodiment 26 or 62 over the much smaller sized exhaust pipes 18. The exhaust pipes 18 shown in the drawings are vertically oriented at least on the terminal end sections or lengths on internal combustion engines such as in truck 20, and can include a short horizontal terminal end bend as shown in FIG. 5. However, cover embodiment 26 and 62 can also be applied to horizontally oriented exhaust pipes, and on machinery other than trucks, such as large farm tractors. The length of cover embodiment 26 and 62 is around one to two feet and sized to fit exhaust pipes 18 having short horizontal, vertical or angled terminal ends defining openings 22. The majority of large truck 20 exhaust pipes 18 are approximately five inches in external diameter, and a cover 10 having an eight inch internal diameter will function well on pipes 18 of this size even if the pipe includes a short horizontal terminal end bend. The material of which the cover body of embodiment 26 and 62 is manufactured preferably possesses a degree of flexibility at least in some areas to allow the intentional collapsing or folding for more compact storage. The material defining the cover body is water repellant, such as a flexible plastic material or woven fabric such as a vinyl impregnated nylon, or other suitable material such as water repellant canvas or the like. Multiple layers of fabric can be utilized to provide increased durability and a degree of stiffness if desired. The water repellent body of cover embodiment 26 and 62 may be fabricated in tubular shape from flat sheet material using traditional sewing methods such as sewn seams 24, or seams and hems created with heat bonding or adhesives, or whatever is appropriate for connecting the cover body material. Cover embodiment 26 and 62 may conceivably be produced without conventional seams such as with flexible plastics material which can be molded in one piece, such as by injection blow molding or the like so that the cover is very thin and flexible.

Figure 1:
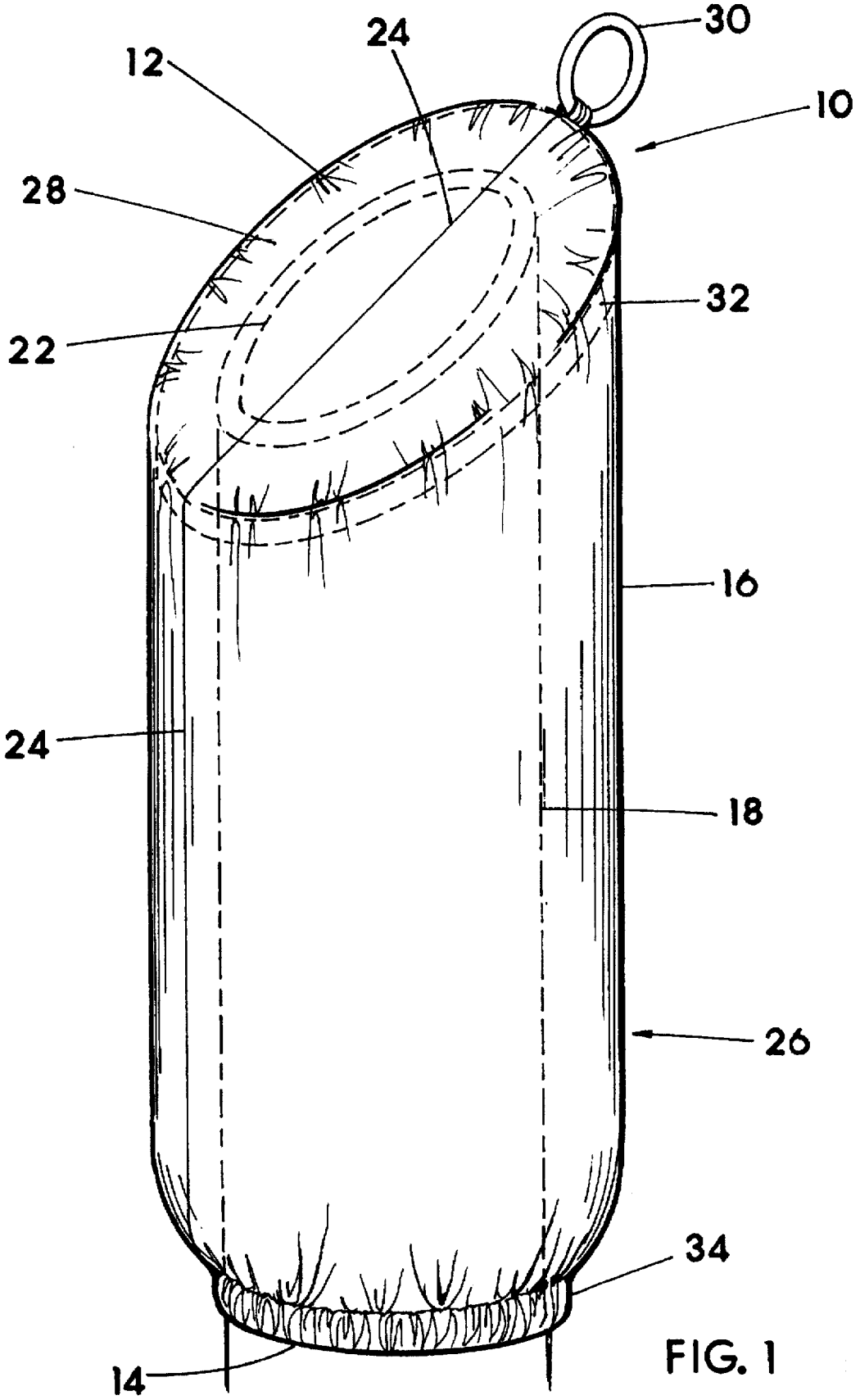
FIG. 1 is a top perspective view of the aforementioned first embodiment of the cover closing the exhaust opening by way of its location over the vertical exhaust pipe section shown in broken lines positioned lengthwise within the cover, and the foam rubber member inside the cover positioned against the angled or sloped terminal end of the exhaust pipe.
Figure 3:
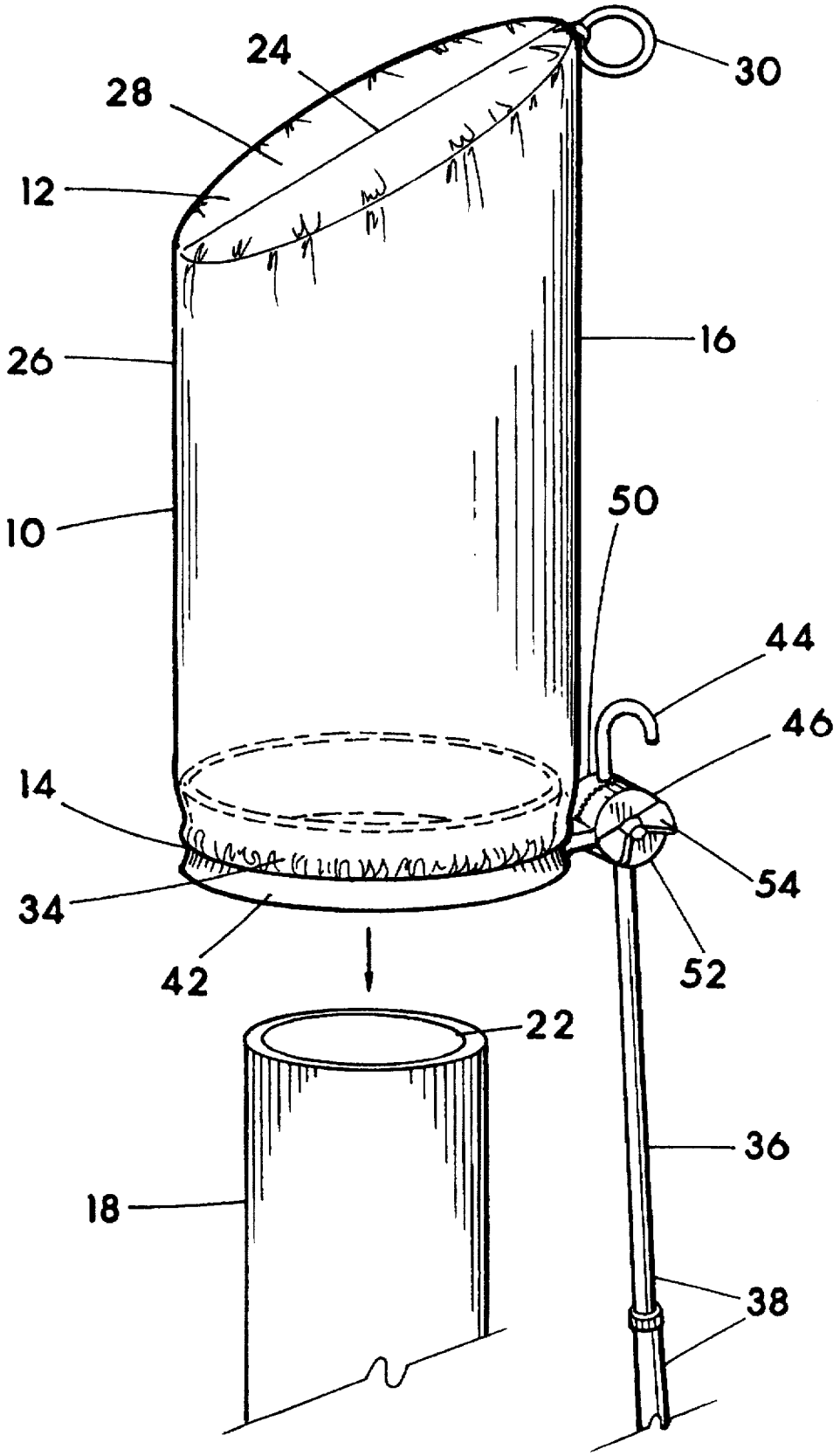
FIG. 3 is a top perspective view of the first embodiment cover attached over the band of the pole and in position for placement over the upper end of a vertical exhaust pipe section having a square-cut terminal end.
Figure 4:
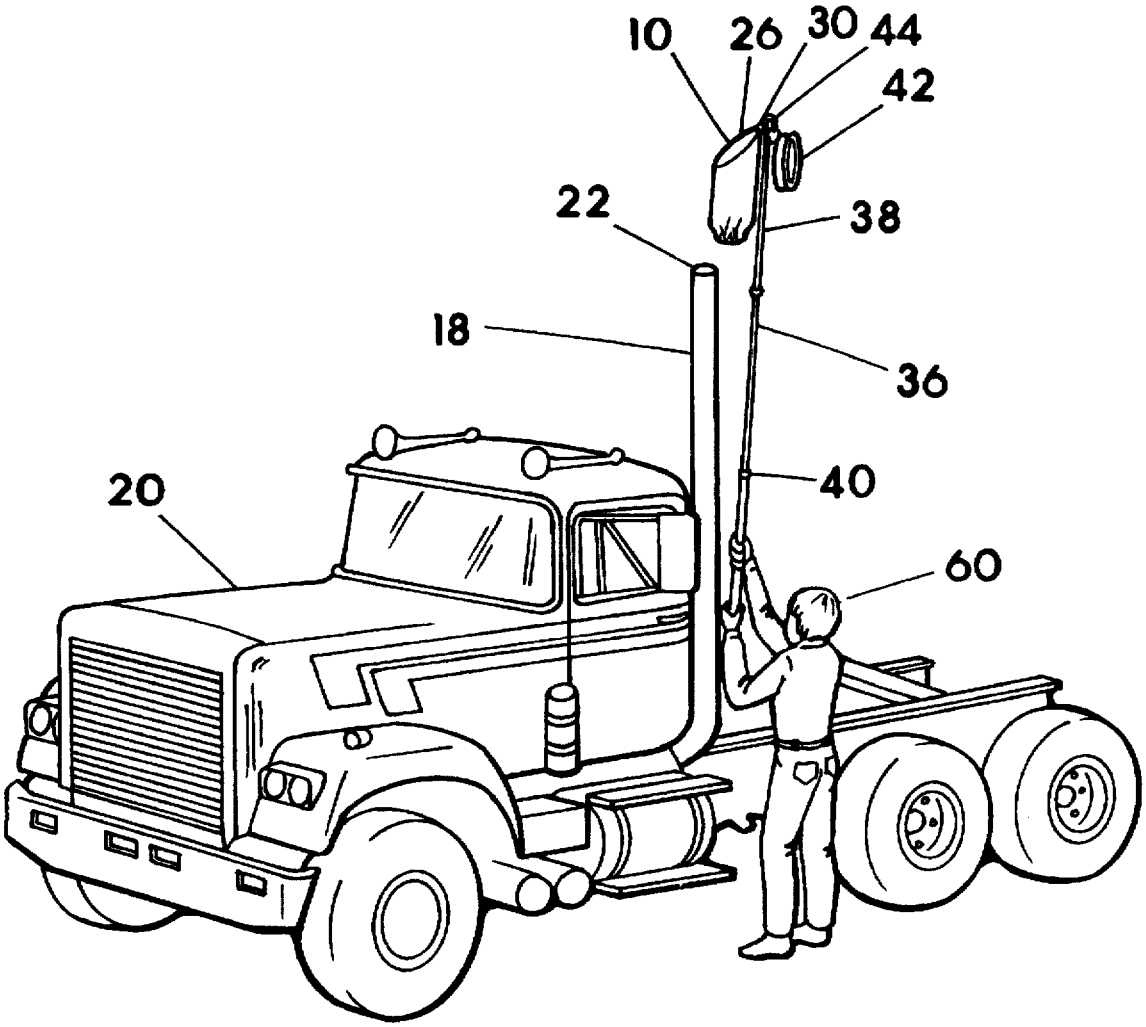
FIG. 4 illustrates the first embodiment cover being removed from the exhaust pipe of a truck with the use of the hook on the telescopic pole.

The first embodiment 26 of cover 10 has an angled top end 28 which is roughly positioned forty-five degrees to the substantially vertical sidewall 16 when in a vertically oriented use position as shown in FIG. 1, although it could be flat-topped like that of embodiment 62. Angled top end 28 is primarily structured for exhaust pipes 18 having angled terminal ends defining exhaust openings 22, although it can be used with the vertical and horizontal terminal ends as shown in FIGS. 3 and 5 respectively on exhaust pipes 18. Angled top end 28 is generally oval in shape with the higher upper end retaining a small metal or plastic circular removal ring 30 which is about one to two inches in diameter. The ring 30 in this example is affixed to the body of the cover by sewing or connecting with thread. The interior surface of angled top end 28 is preferably affixed with a semi-rigid but flexible flat oval foam rubber pad 32 which helps to maintain the oval shape of angled top end 28 and also helps to protect the material of which cover 10 is manufactured from wear by the edge of exhaust pipe 18. Foam pad 32 may be affixed in place with glue or sewing. The lower open bottom end 14 of first embodiment 26 of cover 10 is rimmed with an elasticized gathered hem 34 which in the relaxed state is somewhat smaller in diameter than the exterior diameter of exhaust pipe 18. Gathered hem 34 is capable of being expanded to about the circumference of sidewall 16, which is a little larger than the external diameter of band 42 as will be explained. Hem 34 can be made by stitching a small elastic band into a tubular and circular envelope into the cover material at the bottom end of embodiment 26.

Figure 2:
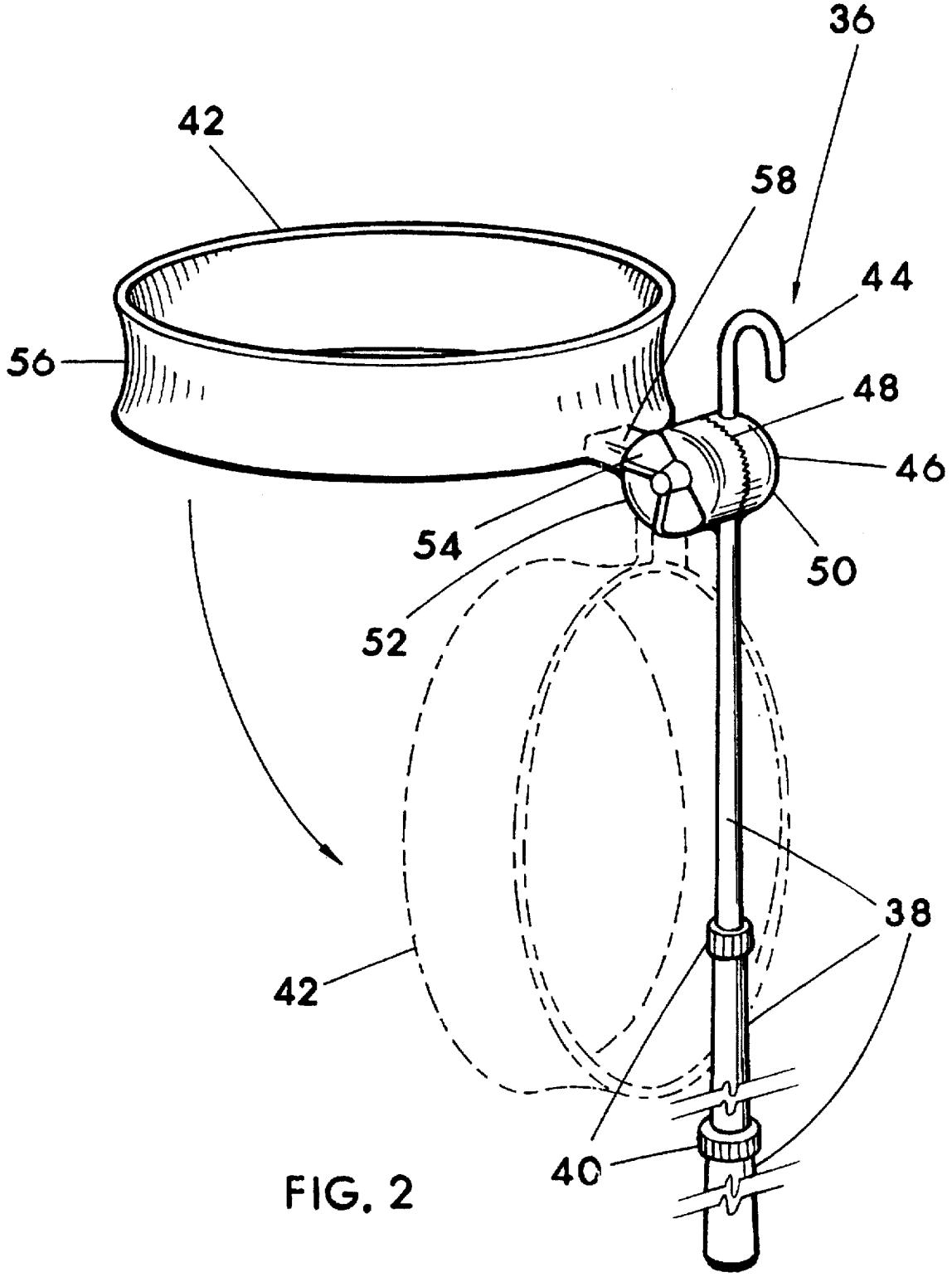
FIG. 2 is a top perspective view of the collapsed pole and pivotal band. The telescopic pole is affixed at the upper terminal end with a hook.

First embodiment 26 of cover 10 is applied and removed from exhaust pipe 18 with the use of telescopic pole 36 which incorporates several elongated interlocking thin tubular sections 38 which extend to around six to ten feet in length, and collapse down to about three or four feet for storage. Telescopic pole 36 can be manufactured of light weight metal such as aluminum or a strong rigid plastic. There are annular compression collars 40 threadably engaged at the upper end of each tubular section 38, except the last or highest section 38, which are used to secure the tubular sections 38 in the extended position. Compression collars 40 are identical or similar to those commonly used on telescopic paint roller handles, long pruning saws and spider-web removing poles and the like, although other arrangements to allow the pole 36 to be shortened and lengthened such as using a plurality of aligned holes and spring detent buttons for example can be used. Pole 36 could, although clearly less desirable, be a single long fixed length within the scope of the invention. Pole 36 and pole 78, are each of sufficient small diameter at the first or lower end to allow grasping in a human hand, preferably with both hands, and are each sufficiently light in weight, preferably under ten pounds to allow an adult human to grasp the pole and maneuver the second end of the pole to any desired position related to an exhaust pipe end. The terminal upper end of pole 36 in this example is affixed with a pivotal attachment band 42 and a stationary hook 44. Both band 42 and hook 44 in the example shown in FIG. 2 are affixed to pole 36 by a lockable pivot connector or lockable hinge 46. Lockable hinge 46 is basically a small two-piece short cylindrical member having interlocking serrated teeth 48 on each of the mating or interfacing surfaces of each half section to prevent unwanted slippage or angular changes in band 42. One half section of hinge 46 is referred to as stationary hinge member 50 and is affixed to the terminal end of telescopic pole 36 with engaged threads, a press fit, welding, adhesives or the like, while the other mating half section is referred to as rotatable hinge member 52. Hook 44 is affixed to the distal end or top of stationary hinge member 50, oppositely disposed to but aligned with the longitudinal axis of pole 36. Hook 44 can be positioned and shaped differently than shown. A winged bolt 54 is centrally positioned through a non-threaded transverse bore of rotatable hinge member 52 and extends to, and is threadably engaged with a threaded transverse bore in stationary hinge member 50. When winged bolt 54 is rotated counter-clockwise or loosened, rotatable hinge member 52 is allowed to be separated slightly from stationary member 50 to rotate, and when tightened, serrated teeth 48 of the interfacing surfaces of members 50 and 52 are again interlocked and members 50 and 52 are stationary relative to one another. Other types of lockable hinges or pivotal arrangements are known and could be used instead of the previously described hinge 46 given for example only. Band 42 does not absolutely need to be "pivotally" connected to the pole, but could be affixed stationary or removably.

Band 42 is a short annular wall 56 of stiff plastics or metal, one to three inches tall, defining a hollow tubular member open through the center and each oppositely disposed end, and about 8 inches in external diameter and about 7¾ inches in open internal diameter when to be used on approximately five inch exhaust pipes 18. Band 42 is preferably made of stiff plastics for weight considerations, and so as to be less likely to scratch the exhaust pipe 18. Band 42 is affixed to rotatable hinge member 52 by a short rigid connecting arm or tab member 58 about one to two inches in length, and around one inch in width, and connected at one end to band 42 by integral casting, molding or any other suitable connection, and connected at the opposite end by integral molding, casting or other suitable manner to rotatable hinge member 52. By being affixed to rotatable hinge member 52, band 42 can be repositioned relative to the lengthwise axis of pole 36, which is generally either parallel, for storage, or at a right angle to pole 36 for use. Band 42 can be locked into many different angles for using the pole to approach an exhaust pipe upper end from varying angles outward from the pipe 18.

First embodiment 26 of cover 10 is applied to exhaust pipe 18 with the use of telescopic pole 36. The elasticized gathered hem 34 of first embodiment 26 is first stretched by hand over and engaged about the sidewall 56 of band 42, which has been positioned at about a right angle to pole 36 and locked into position. The open bottom end 14 of first embodiment 26 of cover 10 is now fully dilated which makes application over exhaust pipe 18 much easier. The inwardly curved sidewall 56 helps prevent gathered hem 34 from inadvertently becoming disengaged with band 42. The individual tubular sections 38 of telescopic pole 36 are extended and interlocked with compression collars 40 to maintain pole 36 in an extended position. First embodiment 26 can also be attached to band 42 after extension of pole 36. Person 60 grasping the lower or first portion of pole 36 then elevates or moves the second end of the pole and connected cover 26 to position the now fully dilated open bottom end 14 of cover 26 above or aligned with the terminal end of the exhaust pipe 18, followed by centering the open bottom end 14 over the terminal end of the pipe 18 and opening 22 on the upper end of exhaust pipe 18. Band 42 is then moved or lowered over exhaust pipe 18 until exhaust pipe 18 enters cover 26 and the terminal end of the pipe 18 abuts the interior upper end or foam pad 32 of cover 26. When installing the cover 26 on an exhaust pipe terminal end which includes a short horizontal bend, the downward movement of the pole and cover will normally require a little sideways motions to bring the cover down over the short horizontal bend, but of course this depends on the length of the bend and size of the cover 26. Person 60 then pulls band 42 downward along the length of pipe 18 until gathered hem 34 is released from engagement with band 42, and snaps tightly about the exterior of exhaust pipe 18. Gathered hem 34 now securely frictionally engages the sides of exhaust pipe 18. The second end of pole 36 with band 42 is then moved or elevated and band 42 is passed over the now attached cover 10 and removed from exhaust pipe 18. The individual sections 38 of telescopic pole 36 are then collapsed downward into one another and band 42 is rotated and positioned against the side of pole 36 for more compact storage.

To remove first embodiment 26 of cover 10 from exhaust pipe 18, telescopic pole 36 is positioned with sections 38 extended, preferably with band 42 positioned downward against pole 36 to be out of the way. Hook 44, located on the upper end of stationary hinge member 50, is maneuvered to the upper end of cover 10 where hook 44 is linked through removal ring 30 and the pole is or should be rotated so that the open side of the hook 44 is basically aiming upward to help prevent unwanted separation of the hook 44 from the ring 30 during lifting. Removal ring 30 is pulled upward by elevating the second end of the pole 36, pulling cover 26 off of exhaust pipe 18. It should be noted that a ring like that of ring 30 could be attached to the end of pole 36 instead of hook 44, and that a hook like that of hook 44 could be attached to cover 26 within the scope of the invention, which is basically a position reversal of hook 44 and ring 30. The cover 26 can now be flattened or folded and stored, and the engine of the machine can be operated. Additionally, if the operator has forgotten to remove the cover from the exhaust pipe when the engine is started, most of the time, depending upon the size of the engine and volume of exhaust gasses, the cover will be blown off when the engine is started.

Second embodiment 62 of cover 10 includes the same tubular shaped sidewall 16 having an open bottom end 14 and a closed top end 12, however the open bottom end 14 of second embodiment 62 is permanently maintained in an open circular position by dilator ring 64. Dilator ring 64 is retained within the hem of open bottom end 14 and is sized slightly smaller in diameter than sidewall 16. Dilator ring 64 is preferably made of a rigid plastic material. Located several inches upward from open bottom end 14 of second embodiment 62 of cover 10 is a draw-string band 66 which can be elastic or non-elastic. Draw-string band 66 is retained within the interior of sidewall 16 within a narrow circular tube-like pocket 68 encircling the body of the cover or sidewall 16, with a small section or loop 70 of draw-string band 66 extending out past sidewall 16 through a small opening 67. A ring 72 which can be made of metal or strong plastics is connected on the loop 70 section of draw-string 66. The exposed ring 72 is around one to two inches in diameter. The upper closed top end 12 of the second embodiment 62 of cover 10 is referred to as horizontal top end 74, and is positioned at a right angle to sidewall 16, rather than angled as in first embodiment 26. An exposed ring 30 is also affixed to horizontal top end 74 of second embodiment 62. Affixed to the exterior of sidewall 16 is an inverted pocket 76 which is sized for insertion of hook 80 on telescopic pole 78, which is a simpler version of pole 36. Pocket 76 will be further explained later. Telescopic pole 78 for use with second cover embodiment 62 also includes tubular sections 38 with compression collars 40, however hook 80 is directly affixed to the distal end of the last tubular section 38, with the elimination of pivotal band 42 and lockable hinge 46.

To attach second embodiment 62 of cover 10 over exhaust pipe 18, telescopic pole 78 is extended and hook 80 is engaged with ring 30 on horizontal top end 74. The dilated open bottom end 14 of second embodiment 62 is then suspended and lowered over exhaust pipe 18. Hook 80 is disengaged from ring 30 by the user manipulating the pole, and then hook 80 is hook through the exposed ring 72 attached to draw-string band 66 retained within circular pocket 68. Ring 72 is pulled outward away from sidewall 16 with pole 78, thereby reducing the diameter of circular pocket 68 due to the action of draw-string band 66 and the flexible nature of sidewall 16, and due to draw-string 66 being retained in pocket 68 a sufficient distance upward or away from dilator ring 64 to provide sufficient cover material inward movement to allow adequate collapsing. Circular pocket 68 and thus sidewall 16 is reduced until it engages with exhaust pipe 18, thereby retaining second embodiment 62 of cover 10 securely in place. Draw-string band 66 binds in the small tight hole 67 through which it exits, and thereby maintains sidewall 16 inwardly collapsed and tight against pipe 18. To remove second cover embodiment 62 of cover 10 from exhaust pipe 18, hook 80 of extended telescopic pole 78 is either inserted into pocket 76 or inserted into ring 30, and using the pole, the cover is simply lifted off of exhaust pipe 18. Although draw-string band 66 is sufficient to retain second embodiment 62 in position during windy weather or during transportation of the vehicle, its engagement can be overcome with a moderate pulling force applied by person 60 against pole 78. A second opening 67 with another exposed loop of the draw-string band 66 with another exposed ring 72 attached to the loop can also be used with this second embodiment 62, which is positioned on the opposite side of the cover from the first opening, which can be used to loosen the tightened band for easier removal of the cover from the exhaust pipe. However, the draw-string band cinching mechanism can simply be overcome, without the use of the second exposed band loop, by merely pulling the cover from the exhaust pipe with firm pressure using the pole hook engaged in the top ring of the cover, or inverted pocket 76. Inverted pocket 76, is simply a small panel of the same material as cover 10, which is affixed at three edges and open on the bottom edge. Pocket 76 can also be used as an alternative attachment pole end sight instead of ring 30, to support cover 10 by hook 80. Pocket 76 provides more stabilization of cover 10 when hook 80 is inserted in the pocket 76, which is beneficial in reducing rotation of cover 62 on pole 78, especially during windy weather.

Both embodiments 26 and 62 of cover 10 can also be used on horizontally positioned exhaust pipe terminal end sections or lengths such as are commonly found on pick-truck and passenger cars and the like, wherein telescopic poles 36 or 78 would generally not be needed in such an application since most horizontally positioned exhaust pipes are within reach of person 60 standing on the ground.

Although not shown in the drawings, a substitute for hook 44 on pole 36 and ring 30 on cover 26, or even possibly hook 80 or in combination with hook 80 of pole 78, and ring 30 and or inverted pocket 76 on pole 78, is a two portion hook and loop fastener arrangement. A first portion of the fastener would be attached to the outside of cover 10 (covers 26 or 62) so as to be exposed and permanently affixed such as by sewing or adhesives. The first portion could be a rather large patch or strip preferably affixed to the upper portion of sidewall 16. The second portion or mating portion of the hook and loop fastener would be connected on the second end of pole 36 such as glued on the outward facing surface of stationary hinge member 50 or even an outer side surface of band 42, or on pole 78. On pole 78 the second or mating portion could be attached by glue or other suitable attachment just below or on the hook end 80 or elsewhere appropriately positioned. The two portion hook and loop arrangement will allow the top or second end of the pole to be used to reach up, engage the two portions of the hook and loop fastener, and remove the cover 10 from an exhaust pipe 18. Alternatively, the hook and loop structuring applied as previously described could be used to install embodiment 62 over an exhaust pipe terminal end by connecting the two portions of hook and loop together on the ground, raising the pole second end and cover 62 above the exhaust pipe 18 terminal end, lowering the open end of the cover over the pipe 18, and then disengaging the hook and loop by further downward pulling on the pole.

Other features or structures which we anticipate can be used alone or in combination with those already previously described include the use of magnetic material mounted in or on the covers 10, such as sewn into the collapsible gathers to further aid in holding the cover 10 in place on a steel exhaust pipe 18, or rubbery strips affixed inside the cover 10 such as on the interior of the collapsible gathers to engage the exhaust pipe with higher sliding-preventing frictional adhesion. We have also considered sewing or otherwise connecting substantial weight, such as sand in sewn bag-like structures in the area of the open bottom end 14 of the cover 10, wherein the weight alone of the cover would maintain it in place atop of a vertically oriented exhaust pipe section even when in a high wind. We have also considered the use of an elongated pole, graspable at the lower or first end, and having a magnet mounted at the second or distal end of the pole, the magnet being engagable to a rigid metal tube cover having ferris material so as to be holdable by the magnet, and having a closed end, an oppositely disposed open end and open interior for fitting over the exhaust pipe, much like that described above, and the metal tube once placed over the exhaust pipe to seal the exhaust opening could be disengaged by manually manipulating the pole such as by rotating the pole or sliding the magnet portion off of the lower edge of the rigid tube. This rigid metal tube cover and the use of the magnetized pole second end is believed to be within the scope of our invention, and a useful arrangement.

It should be understood that various features of one embodiment can be mixed and matched with various other features of different embodiments according to the invention, including deletions and or additions of some features, to define hybrid embodiments not herein shown or fully described in the interest of brevity, but within the scope of the present invention. Additionally, although we have very specifically described preferred structures and methods of use of the invention, it should be understood that many changes in the specific structures and methods described and shown can clearly be made without departing from the true scope of the invention in accordance with the appended claims.

What we claim is:

1. An elongated pole and cooperative cover combination for use in covering an exhaust pipe terminal end with exhaust opening, for excluding foreign matter from entering the exhaust pipe opening, comprising;

said elongated pole including a first end of said pole graspable by human hands; and having an oppositely disposed second end of said pole affixed with component means for engaging and holding said cover for allowing said pole to be held by hand and lifted to elevate the pole second end and said cover;

said cover comprising a tubular water repellant body having a closed end land an oppositely disposed open end, the open end and an interior of said cover sized sufficiently for allowing placement of said cover over an exhaust pipe terminal end and exhaust opening utilizing said pole to manipulate and position said cover relative to the exhaust pipe terminal end and exhaust opening;

said component means on said second end of said pole being disengagable from engaging and holding said cover by way of manual manipulation of said pole for allowing disengagement of said component means from said cover, whereby said pole and said cover can be separated from one another after said cover has been placed over an exhaust pipe terminal end and exhaust opening.

2. An elongated pole and cooperative cover combination for use in covering an exhaust pipe terminal end with exhaust opening, for excluding foreign matter from entering the exhaust pipe opening, comprising;

said elongated pole including a first end of said pole graspable by human hands; and having an oppositely disposed second end of said pole affixed with first component means for engaging a cooperative second component means affixed to said cover for engaging said first component means;

the first and second component means when engaged with one another allowing said pole to be held by hand and lifted to elevate the pole second end and said cover;

said cover comprising a tubular body defined primarily by water repellant material and having a closed end and an oppositely disposed open end, the open end and an interior of said cover sized sufficiently for allowing placement of said cover over an exhaust pipe terminal end and exhaust opening utilizing said pole to manipulate and position said cover relative to the exhaust pipe terminal end and exhaust opening;

the first and second component means further including disengagement means for allowing manipulation of said pole to disengage the first and second component means from one another, whereby said pole can be separated from said cover after said cover has been placed over an exhaust pipe terminal end and exhaust opening.

3. An elongated pole and cover according to claim 2 wherein said pole is telescopically length adjustable.

4. An elongated pole and cover according to claim 3 wherein said first component means includes an open band affixed to said pole and extending generally laterally from said pole; and said cover is flexible and said second component means includes said open end being normally inwardly collapsed by elastic means, wherein said open end normally inwardly collapsed by said elastic means is manually expandable for placement about said open band.

5. An elongated pole and cover according to claim 4 wherein said open band is affixed to said pole by hinge means for allowing said open band to be repositionable relative to said pole.

6. An elongated pole and cover according to claim 5 wherein a hook is attached to said second end of said pole, and an exposed ring is attached on said cover, said ring being engagable by said hook, whereby said hook on said pole can be engaged with said ring to allow pulling of said cover off of an exhaust pipe.

7. A method of covering an opening on a difficult to reach exhaust pipe section for preventing foreign matter from entering the opening on the exhaust pipe section, comprising the steps of;

(a) attaching a tubular cover member having a closed end and an oppositely disposed open end to a pole;

(b) positioning said open end of said tubular cover member with said pole over said exhaust pipe section;

(c) placing said tubular cover member by moving said pole so as to place said tubular cover member over and about said exhaust pipe section and covering the opening of the exhaust pipe section; and (d) disengaging said pole from said tubular member.

8. A method according to claim 7 further including utilizing said pole which includes an open band affixed thereto and extending generally laterally from said pole, and manually locating said open end of said tubular cover member about the open band for attaching the tubular cover member to said pole.

* * * * *